US006626369B1

(12) United States Patent
Magel

(10) Patent No.: US 6,626,369 B1
(45) Date of Patent: Sep. 30, 2003

(54) INJECTION DEVICE AND METHOD FOR INJECTION OF FLUIDS

(75) Inventor: Hans-Christoph Magel, Pfullingen (DE)

(73) Assignee: Robert Bosch GmbH, Stuttgart (DE)

( * ) Notice: Subject to any disclaimer, the term of this patent is extended or adjusted under 35 U.S.C. 154(b) by 122 days.

(21) Appl. No.: 09/868,004

(22) PCT Filed: Oct. 17, 2000

(86) PCT No.: PCT/DE00/03657

§ 371 (c)(1),
(2), (4) Date: Jun. 12, 2001

(87) PCT Pub. No.: WO01/29409

PCT Pub. Date: Apr. 26, 2001

(30) Foreign Application Priority Data

Oct. 22, 1999 (DE) ..... 199 51 005

(51) Int. Cl.[7] ..... F02M 47/02
(52) U.S. Cl. ..... 239/88; 239/92; 239/96
(58) Field of Search ..... 239/88–92, 95, 239/96; 123/467, 446, 447, 496, 357, 514

(56) References Cited

U.S. PATENT DOCUMENTS 4,170,974 A 10/1979 Kopse et al.
5,732,679 A * 3/1998 Takahasi et al. ..... 123/467
5,826,561 A * 10/1998 Mack et al. ..... 123/446
5,954,030 A 9/1999 North
5,964,406 A 10/1999 Zuo
5,967,413 A 10/1999 Tian

FOREIGN PATENT DOCUMENTS

EP 0 562 046 A 9/1993
EP 0 816 670 A 1/1998
GB 2 009 842 A 6/1979

* cited by examiner

*Primary Examiner*—Lisa A. Douglas
(74) *Attorney, Agent, or Firm*—Michael J. Striker

(57) ABSTRACT

The present invention relates to an injection device having an injection valve (12), a valve device (18, 20) for controlling the injection, and a setting element (22) for operating the valve device (18, 20), the valve device having at least one first valve (18) and a second valve (20) which can be operated by the settling element (22) via a common hydraulic coupling space (24). The present invention further relates to a method for injecting fluid in which a setting element is (22) is activated, a valve device (18, 20) is operated by the setting element (22), and an injection valve (12) is opened, the first valve (18) and a second valve (20) of the valve device (18, 20) being operated by the setting element (22) via a common hydraulic coupling space.

17 Claims, 1 Drawing Sheet

INJECTION DEVICE AND METHOD FOR INJECTION OF FLUIDS

RELATED ART

Figure 1:
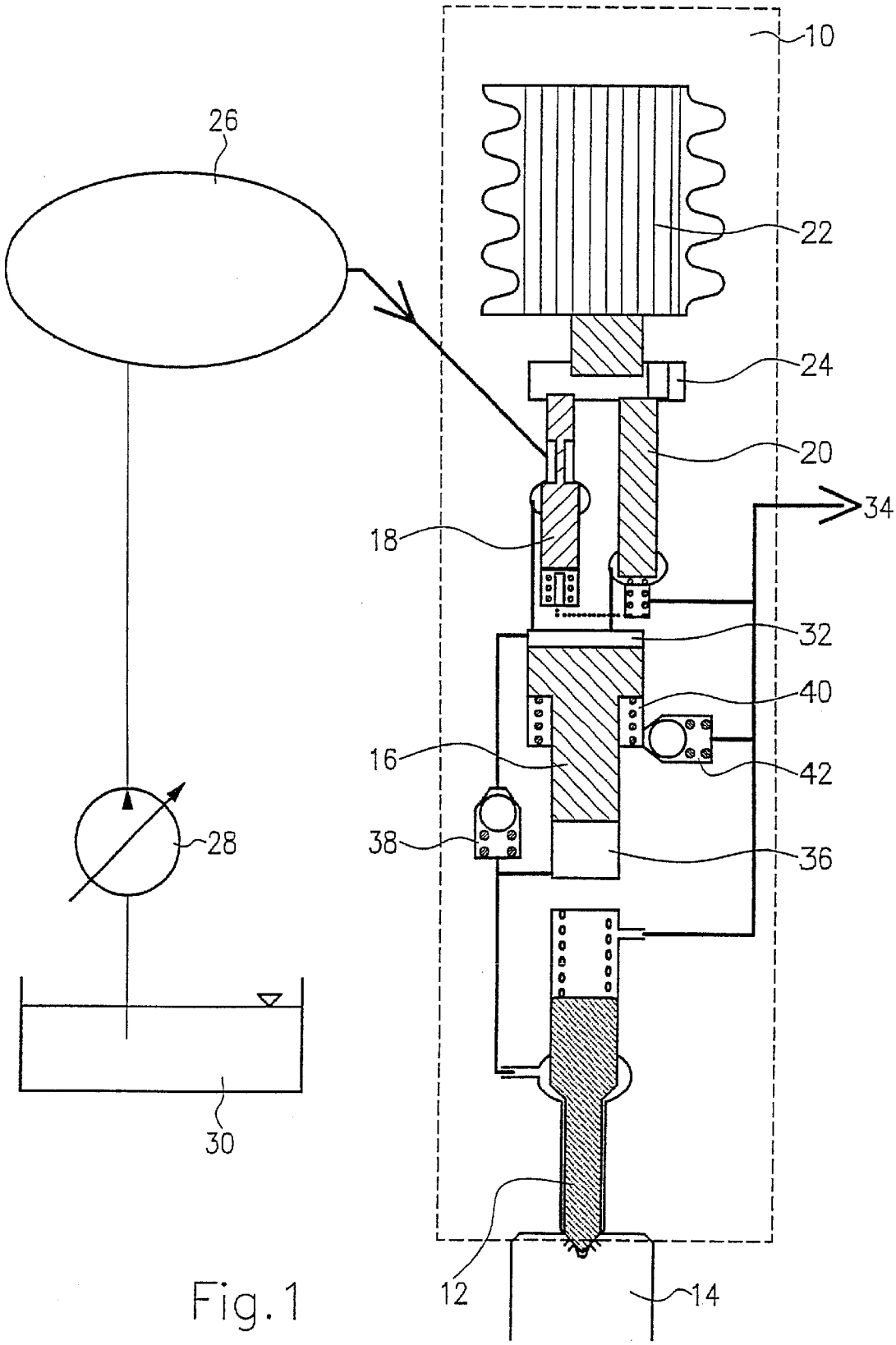

The present invention relates to an injection device with an injection valve, a valve device for controlling the injection, and a setting element for operating the valve device. The present invention further relates to a method for injecting fluid in which a setting element is activated, a valve device is operated by the setting element, and an injection valve is opened.

A generic device and a generic method are made known, for instance, in European Patent No. 0 562 046 B1. The basic requirement on such a system is that fuel injection be carried out using the highest injection pressure possible. High injection pressure has positive effects on the performance of an engine; for instance, it reduces emissions and fuel consumption. To achieve high injection pressure, a pressure booster can be provided which converts a primary pressure, e.g., provided by a pressure accumulator, into the desired high injection pressure via hydraulic pressure intensification. By making a suitable selection of surfaces of the pressure booster to which force is applied and the counterforces of elastic materials, a suitable pressure increase can be set.

To control injection, a valve device is provided which is operated by a setting element, e.g., a solenoid valve or a piezoactuator. This valve device serves to feed the primary pressure to be intensified to the pressure booster, to perform depressurization, and to refill the pressure booster after the pressure has been increased and, consequently, injection has taken place via the injection valve.

The related art uses a 3/2 valve as the valve device. In an initial control state of the 3/2 valve, the flow of fuel between a fuel inlet and the primary side of the pressure booster is blocked. On the other hand there is a connection between the primary side of the pressure booster and the leakage system. If the setting element of the injection device is now operated, the 3/2 valve switches to a transition state in which a connection exists between the fuel inlet and the primary side of the pressure booster as well as between the primary side of the pressure booster and the leakage system. When the setting element is operated further, the second control state of the 3/2 valve is accepted, in which the connection of the primary side of the pressure booster with the leakage system is blocked, but the connection between the fuel inlet and the primary side remains open. When the pressure booster is depressurized or refilled, the 3/2 valve moves through the control states described in reverse sequence.

In the solution of the related art described, the fact that high leakage rates occur proved especially problematic. They degrade the effectiveness of the injection system. Furthermore, a 3/2 valve is only conditionally suited for high-pressure applications, especially with regard for manufacture and sealing.

A generic pressure increase is useful especially in connection with a common rail system. In common rail fuel injection, primary pressure generation and injection are decoupled. The injection pressure is generated independently of the engine speed and the injection quantity and is made available in the "rail" (fuel line) for injection. A favorable course of injection can be fundamentally achieved in this manner, because the injection pressure and injection quantity, in particular, can be determined independently of each other for each operating point of the engine. However, the pressure in the common rail is still limited to approximately 1600 bar at this time; increasing the pressure is desired for reasons related to emissions and fuel consumption. A pressure booster in combination with a common rail system could therefore deliver especially good results. The problems mentioned above exist as a result of the use of the 3/2 valve, however, which has a detrimental effect overall on the performance of the injection system.

ADVANTAGES OF THE INVENTION

The injection device provided by the present invention according to claim 1 is based on the related art in that the valve device includes at least one first valve and a second valve which can be operated by the setting element via a common hydraulic coupling space. In this manner, the disadvantages are prevented, for instance, that occur with the use of a 3/2 valve made known in the related art. Since both valves can be operated by the same setting element, the equipment expenditure is not increased at this point as compared with the use of a single 3/2 valve, so that, overall, the system is improved. For instance, by suitably adjusting the elastic materials, it is possible for the valves to respond to activation by the setting element at different points in time. The hydraulic coupling space also serves to provide a power-travel transfer that may be necessary and to offset tolerances, e.g. changes in length.

Preferably, a pressure booster for boosting a primary pressure is provided, which can be operated by the valve device. High injection pressure can be achieved especially well in this manner. Since it is no longer necessary to provide a 3/2 valve, the large pressure differences that arise due to the pressure booster can be controlled while avoiding high losses due to leakage.

The setting element is preferably a piezoactuator. Piezoactuators have proven successful as electronically controllable setting elements, especially since they are compact in design and perform reliably. Moreover, the setting function can be changed by changing the parameters (voltage, pulse duration) of the control.

The primary pressure is preferably provided by a common rail. It is hereby possible to combine the advantages of a common rail system with the pressure-boosted injection device. The common rail pressure, which is currently limited to approximately 1600 bar, can be intensified; this reduces emissions and fuel consumption.

It is advantageous for the injection system to be pressure-controlled. This ensures that the injection valve actually opens only above a certain threshold pressure. This guarantees the advantages of injection using high pressure under all circumstances.

Preferably, the first valve in a first state separates the primary pressure from a low-pressure space of the pressure booster, and the first valve in a second state injects the primary pressure into the low-pressure space of the pressure booster. The first valve is thereby used as a metering valve, its opening states decisively determining the supply of the system with fuel.

It is advantageous when the second valve in a first state couples a low-pressure space of the pressure booster with a leakage system, and the second valve in a second state separates the low-pressure space of the pressure booster from the leakage system. The second valve can thereby serve as a discharge valve for the pressure valve; moreover, the pressure booster can be filled using the second valve.

It is especially advantageous when the first valve and the second valve are coordinated with each other in such a way that, by operating the setting element, the second valve can first be transferred from its first state to its second state and, as a result, the first valve can be transferred from its first state to its second state. This ensures that the opening cross-sections of the valves do not overlap. This leads to a marked reduction in the leakage rate that occurs, because the second valve is already closed when the first valve is still located in its closed first state. Additionally, it is possible to open and close the first valve numerous times (in a timed manner) while the second valve remains closed.

Preferably, a low-pressure space of the pressure booster is connected with a high-pressure space of the pressure booster via a check valve, by means of which the high-pressure space can be filled. The high-pressure space must be filled in every injection cycle so that fluid is available for high-pressure injection. A check valve prevents the high pressure from the high-pressure space of the pressure booster from reaching the low-pressure space of the pressure booster; on the other hand, the check valve makes it possible for the high-pressure space to be filled from the low-pressure space.

It can also be an advantage when a high-pressure space of the pressure booster is connected with the leakage system via a check valve. This makes it possible to completely decouple the low-pressure space and the high-pressure space of the pressure booster from each other and to refill the high-pressure space using the fluid present in the leakage system.

Preferably, a differential space of the pressure booster is connected with the leakage system via a check valve, so that the differential space is not filled. Although the check valve ensures that the leakage rate that occurs in the differential space discharges into the leakage system, it prevents the differential space from being filled, which decreases the overall volume to be filled in advantageous manner.

It can also be an advantage when, instead of the low-pressure space, the high-pressure space of the pressure booster can be relieved via the second valve. In this manner, the injection valve can be discharged more quickly than in the variant with discharge on the low-pressure side of the pressure booster. When the high-pressure space is relieved via the second valve, however, it must be taken into consideration that the valve system experiences increased stress due to the high pressure in the high-pressure space.

The fact that the first valve and/or the second valve is/are (a) 2/2 valve(s) can be useful. When this is this case, the necessary logic switching functions can be carried out, which are performed by a 3/2 valve in the related art.

Preferably, the first valve and the setting element are coordinated with each other in such a way that the first valve can be transferred continuously or in stages into different opening states with different opening cross-sections. This can be advantageous in conjunction with preinjection, for instance. By throttling in the valve seat of the first valve, very small preinjection quantities with reduced injection pressure can be achieved. To achieve this, the interplay of the first valve and the setting element is designed so that continuous cross-sectional control of the first valve or a step-wise opening of the first valve is made possible. The rapid switching time of a piezoactuator can be utilized to advantage here. Additionally, due to the cross-sectional control of the first valve, the course of injection can be formed.

The present invention is based on the generic procedure according to claim 13 in that a first valve and a second valve of the valve device are operated by the setting element using a common hydraulic coupling space. Although two valves are used as replacement for one 3/2 valve, the course of the process can be designed in a simple manner. Only one single setting element and its preferably electronic control are required to operate the first valve as well as the second valve.

A pressure booster for boosting a primary pressure is preferably operated by the valve device. In this manner, an advantageously high injection pressure can be achieved in the system.

The injection valve is preferably opened when a certain pressure is exceeded in its inlet region. A pressure-controlled system of this type is especially preferred with the advantageous use of high injection pressures, because the controlling variable—the pressure—is also the decisive parameter for the quality of injection.

Preferably, the method is further designed in such a way that, when the setting element is operated, a low-pressure space of the pressure booster is decoupled from a leakage system by the closing of the second valve, which causes the primary pressure in the low-pressure space to be decoupled by the opening of the first valve, which causes the pressure in an inlet region of the injection valve to exceed a certain pressure, so that the injection valve opens, which causes the first valve to close and, as a result, the second valve opens, so that injection is ended and the pressure booster is depressurized. As a result of this course of the process, the opening cross-sections of the two valves do not overlap, which leads to an advantageous reduction in the leakage rate. Moreover, the switching states are suitable for making a rapid pressure build-up possible as well as achieving reliable discharge of the pressure booster and the injection valve. Moreover, numerous switching operations of the first valve are possible while the second valve is closed.

Preferably, the high-pressure space of the pressure booster is filled via a check valve, by means of which it is connected with the low-pressure space. Since a sufficient fluid reservoir is present in the low-pressure space when the valve is open, it is useful to use this to fill the high-pressure space via a check valve. Conversely, the high pressure from the high-pressure space cannot cross over into the low-pressure space of the pressure booster through the check valve; it is used entirely to control the injection valve.

It can also be advantageous that the high-pressure space of the pressure booster is filled via a check valve, by means of which it is connected with the leakage system. A complete decoupling from the low-pressure space and the high-pressure space of the pressure booster is then present and, at the same time, the high-pressure space can be filled from a reservoir of sufficient size.

It can also be useful when the high-pressure space of the pressure booster is relieved via the second valve. Under certain circumstances, this can lead to a more rapid discharge, although it must be taken into consideration that the valve device must bear higher pressures.

Preferably, the first valve is transferred into different opening states continuously or in stages. In this manner, using the first valve as the metering valve, the course of injection can be formed and preinjection with a small preinjection quantity and reduced injection pressure can be achieved. This is made favorable by the rapid switching times made possible with a piezoactuator.

The present invention is based on the surprising finding that, by using two valves, an injection device, especially one having a pressure booster, can be controlled in a reliable manner. The disadvantages that occur when a 3/2 valve is used are eliminated. Moreover, a disadvantageous increase in equipment expenditure does not occur. It should be pointed out here that only one single setting element is sufficient to operate both valves.

DRAWING

The present invention will now be explained with reference to the accompanying drawing based on a preferred embodiment as an example.

FIG. 1 is a schematic diagram of an injection device according to the present invention.

DETAILED DESCRIPTION OF THE DRAWING

FIG. 1 shows an injection device 10 which can be used especially in diesel engines. The injection device 10 includes an injection valve 12 with which diesel fuel is injected into the combustion chamber 14 of an engine. Fuel from a pressure booster 16 is fed under high pressure to the injection valve 12. This pressure booster 16 is operated by a valve device that has a first 2/2 valve 18 and a second 2/2 valve 20. Both 2/2 valves 18, 20 are operated by a single setting element, which is designed in the present embodiment as a piezoactuator 22. The piezoactuator 22 controls the two 2/2 valves by means of a common coupling space 24. The primary pressure is fed to the first 2/2 valve by a common rails 26 in which a pressure of between 300 and 1000 bar commonly exists, whereby maximum pressures of 1600 bar can be reached in the common rail. The pressure in the common rail 26 is built up by a volume-controlled high-pressure pump 28, which is connected with a fuel tank 30.

The piezoactuator 22 is activated in order to initiate an injection process. The force of the piezoactuator 22 is transferred simultaneously via the coupling space 24 to the first 2/2 valve 18 and the second 2/2 valve 20. In the starting state, the first 2/2 valve 18 is closed, while the second 2/2 valve 20 is open. The closed state of the first 2/2 valve 18 causes the low-pressure space 32 of the pressure booster 16 to be decoupled from the primary pressure in the common rail 26. As a result of the open state of the second 2/2 valve 20, the low-pressure space 32 of the pressure booster 16 is connected with a leakage system 34. If the force from the piezoactuator 22 is now transferred to the 2/2 valves 18, 20 via the coupling space 24, the second 2/2 valve 20 closes, and only then does the first 2/2 valve 18 open. This operating sequence can be achieved by trimming the two 2/2 valves involved, especially by making a suitable selection of hydraulic attack surfaces involved and the elastic forces. Due to the operating sequence of the 2/2 valves, pressure does not build up in the low-pressure space 32 of the pressure booster 16 until a point in time at which the connection between the low-pressure space 32 and the leakage system 34 is already blocked by the second 2/2 valve 20. The pressure build-up in the low-pressure space 32 of the pressure booster 16 can therefore take place rapidly and, due to an absence of overlap of the opening cross-sections of the two 2/2 valves, the leakage rate that occurs is reduced considerably. The pressure generated in the low-pressure space 32 of the pressure booster 16 is intensified by the pressure booster 16, so that high pressure occurs in the high-pressure space 36 of the pressure booster 16. This is transferred to the pressure-controlled injection valve 12, the injection valve 12 opens when a threshold pressure is exceeded, and the injection takes place using the correspondingly high pressure.

If the 2/2 valves 18, 20 now move back into their starting positions—the first 2/2 valve 18 first, followed by the second 2/2 valve 20—via deactivation of the piezoactuator 22, the pressure booster 16 can be relieved via the second 2/2 valve 20 and filled. In this process, the high-pressure space is filled via a check valve 38 which is arranged between the low-pressure space 32 and the high-pressure space 36 of the pressure booster 16. In the injection process described above, this check valve 38 has the task of preventing fluid from flowing from the high-pressure space 36 into the low-pressure space 32 of the pressure booster 16. The further leakage rate occurring in the differential space 40 of the pressure booster 16 is discharged into the leakage system 34 by means of a check valve 42. The presence of a check valve 32 prevents the differential space 40 from being filled while the pressure booster 16 is being relieved, and therefore reduces the pertinent volumes to be filled in advantageous manner.

The basic course of the process described can be modified in multiple ways, especially with regard for a distinction between preinjection and main injection, as well as for the formation of the course of injection. Changes of these types can be achieved in an advantageous manner by adjusting the system including the piezoactuator 22 and the first 2/2 valve 18, especially by gradually opening the first 2/2 valve in a continuous or discontinuous manner. The adjustment of the first 2/2 valve is carried out here by the hydraulic cross sections involved.

The preceding description of the embodiments according to the present invention only serve as an illustration and not to limit the invention. Various changes and modifications are possible within the framework of the invention without leaving the scope of the present invention or its equivalents.

What is claimed is:

1. Injection device having an injection valve (12), a valve device (18, 20) for controlling the injection, and a settling element (22) for operating the valve device (18, 20), characterized in that the valve device has at least one first valve (18) and a second valve (20), which can be operated by the settling element (22) via a common hydraulic coupling space, wherein a pressure booster for intensifying a primary pressure is provided, which can be operated by the valve device (18, 29), wherein the first valve (18) in a first state separates the primary pressure from a low-pressure space (32) of the pressure booster (16), the first valve (18) in a second states injects the primary pressure in the low-pressure space (32) of the pressure booster (18), the second valve (20) in a first state couples a low-pressure space (32) of the pressure booster (16) with a leakage system (34), and the second valve (20) in a second state separates the low-pressure space (32) of the pressure booster (16) from the leakage system (34).

2. Injection device according to claim 1, wherein the settling element is a piezoactuator (22).

3. Injection device according to claim 1, wherein it is arranged in a common rail system.

4. Injection device according to claim 1, wherein it is pressure controlled.

5. Injection device according to claim 1, wherein the first valve (18) and the second valve (20) are coordinated with each other in such a way that, when the setting element (22) is operated, the second valve (20) can first be transferred from its first state to Its second state and, as a result, the first valve (18) can be transferred from its first state into its second state.

6. Injection device according to claim 1, wherein a low-pressure space (32) of the pressure booster (16) is connected with a high-pressure space (36) of the pressure booster (16) via a check valve (38), by means of which the high-pressure space (36) of the pressure booster (16) can be filled, and a high-pressure space (36) of the pressure booster (16) is connected with a leakage system (34) via a check valve.

7. Injection device according to claim 1, wherein a differential space (40) of the pressure booster (16) is connected with a leakage system (34) via a check valve, so that the differential space (40) is not filled.

8. Injection device according to claim 1, wherein a high-pressure space (36) of the pressure booster (16) can be depressurized by the second valve (20).

9. Injection device according to claim 1, wherein the first valve (18) and/or the second valve (20) is/are (a) 2/2 valve(s).

10. Injection device according to claim 1, wherein the first valve (18) and the setting element (22) are coordinated with each other in such a way that the first valve (18) can be transferred continuously or in steps into different opening states having different opening cross-sections.

11. Method for injecting fluid in which a settling element (22) is activated, a valve device (18, 20) is operated by the settling element (22), and an injection valve (12) is opened, wherein an initial valve (18) and a second valve (20) of the valve device (18, 20) are operated by the selling element (22) via a common hydraulic coupling space (24), wherein when the settling element (22) is operated, a low-pressure space (32) of the pressure booster (16) is decoupled from a leakage system (34) by the closing of the second valve (20), which causes the primary pressure in the low-pressure space (32) to be injected into the low-pressure space (32) by the opening of the first valve (18), which causes the pressure in an inlet region of the injection valve (12) to exceed a certain pressure, so that the injection valve (12) opens, which causes the first valve (18) to close, which causes the second valve (20) to open, so that injection is ended and the pressure booster (16) is depressurized.

12. Method according to claim 11, wherein a pressure booster (16) for intensifying a primary pressure is operated by the valve device (13, 20).

13. Method according to claim 11, wherein the injection valve (12) is opened when a certain pressure is exceeded in its inlet region.

14. Method according to claim 12, wherein a high-pressure space (36) of the pressure booster (16) is filled by means of a check valve (38), by means of which it is connected with a low-pressure space (32) of the pressure booster (16).

15. Method according to claim 12, wherein a high-pressure space (36) of the pressure booster (16) is filled by means of a check valve, by means of which it is connected with a leakage system (34).

16. Method according to claim 12, wherein a high-pressure space (36) of the pressure booster (16) is depressurized by a second valve (20).

17. Method according to claim 11, wherein the first valve (18) is transferred continuously or in steps into different states of opening having different opening cross-sections.

* * * * *